United States Patent [19]

Dill

[11] Patent Number: 4,684,933

[45] Date of Patent: Aug. 4, 1987

[54] UNAUTHORIZED PERSONNEL DETECTION SYSTEM

[75] Inventor: James M. Dill, Pompano Beach, Fla.

[73] Assignee: Rita Ann Gray, Coral Springs, Fla.

[21] Appl. No.: 863,304

[22] Filed: May 15, 1986

[51] Int. Cl.[4] ..... G08B 13/26

[52] U.S. Cl. ..... 340/572; 340/567; 340/573

[58] Field of Search ..... 340/572, 573, 562

[56] References Cited

U.S. PATENT DOCUMENTS

| | | | |
|---|---|---|---|
| 2,355,395 | 8/1944 | Rubenstein | 177/352 |
| 3,455,835 | 5/1969 | Rudaley | 340/258 |
| 3,493,954 | 2/1970 | Bartlett et al. | 340/258 |
| 3,723,862 | 3/1973 | Wentzel et al. | 324/41 |
| 4,095,214 | 6/1978 | Minasy | 340/572 |
| 4,555,696 | 11/1985 | Brown | 340/572 |
| 4,598,275 | 7/1986 | Ross et al. | 340/573 |

*Primary Examiner*—Glen R. Swann, III

*Attorney, Agent, or Firm*—Oltman and Flynn

[57] ABSTRACT

A detection system for a doorway discriminates between persons who are authorized to go through the doorway and those who are not. An oscillator with a resonant L-C circuit includes metallic capacitor plates on opposite sides of the doorway to reduce the oscillator frequency when a person walks through and to provide a transient frequency increase if the person wears or carries a small metal object. A discriminating circuit is connected to the oscillator output to discriminate between persons in the doorway with and without such a metal object.

8 Claims, 5 Drawing Figures

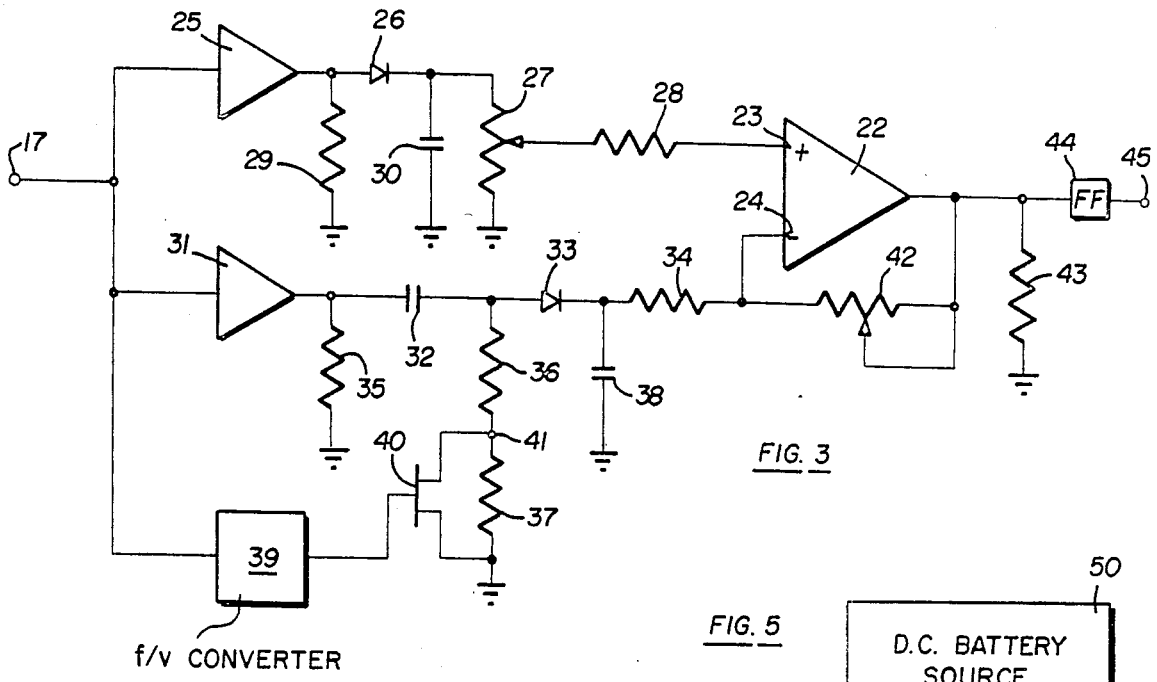
FIG. 3
FIG. 5
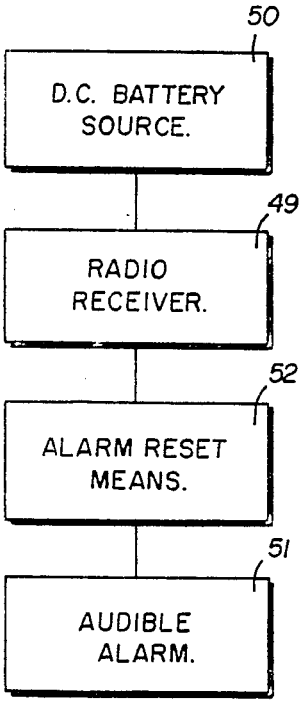
FIG. 4
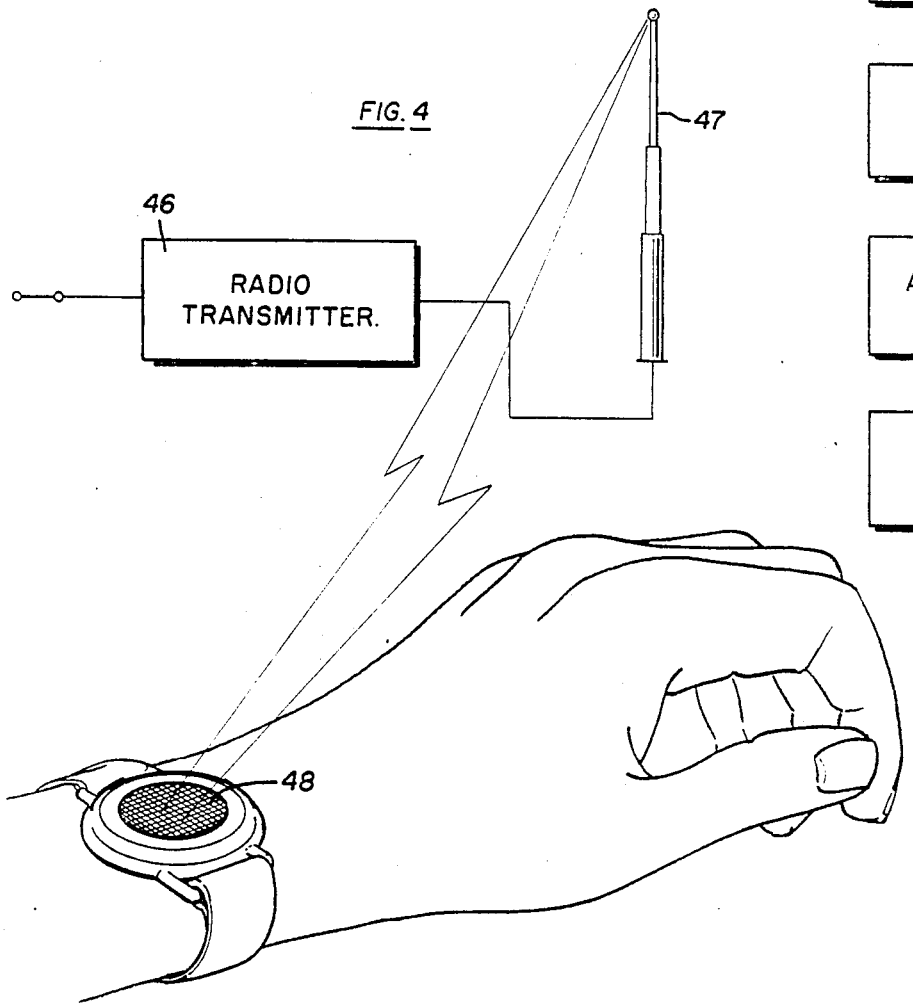

UNAUTHORIZED PERSONNEL DETECTION SYSTEM

SUMMARY OF THE INVENTION

This invention relates to a detection system for use in a passageway, such as a doorway, to discriminate between persons who are authorized to pass through the doorway and persons who are not, such as patients in a mental institution who are not supposed to leave a designated area on one side of the doorway unless escorted by a nurse or other staff member.

In accordance with the present invention, metal plates on opposite sides of the doorway are the plates of a capacitor in a tuned-circuit oscillator. The frequency of this oscillator is relatively high as long as no one is between the capacitor plates because air has a low dielectric constant. A person's body has a much higher dielectric constant so the oscillator frequency drops while a peson is passing through the doorway. If the person is wearing or carrying an electrically conductive article, such as a small metal object, this produces a transient increase of the oscillator frequency while that object is between the capacitor plates.

In the preferred embodiment of the invention, the oscillator output is connected by two separate circuit paths to the non-inverting and inverting inputs of an operational amplifier. One circuit path includes a buffer amplifier, a low pass filter and a potentiometer. The other circuit path includes a buffer amplifier, a variable high pass filter, and a low pass filter. The cutoff frequency of the high pass filter is varied by a frequency-to-voltage conveter connected to a field effect transistor which is part of the resistive impedance in the high pass filter, so that the cutoff frequency follows changes in the oscillator frequency.

The potentiometer is adjusted so that the ouput of the operational amplifier is substantially at its mid-point when a person with no metal object is between the capacitor plates. The time constants of the two sepaarate circuit paths (to the non-inverting input and the inverting input, respectively, of the operational amplifier) are different enough that the presence of a metal object on the person in the doorway causes the operational amplifier to produce a transient output signal, which may be used to operate an alarm signalling arrangement.

A principal object of this invention is to provide a novel detection system for use at a passageway, such as a doorway, to discriminate between authorized and unauthorized persons there.

Another object of this invention is to provide such a detection system which differentiates between a person in the passageway who is wearing or carrying an electrically conductive article, such as a metal object, and a person who is not.

Another object of this invention is to provide such a system in which metal plates on opposite sides of the doorway or other passageway are the plates of a capacitor which controls the frequency of an oscillator.

Further objects and advantages of this invention will be apparent from the following detailed description of a presently preferred embodiment which is illustrated schematically in the accompanying drawings.

DESCRIPON OF THE DRAWINGS

FIG. 3 is a schematic circuit diagram of a circuit connected to the output of the FIG. 2 oscillator and capable of responding to changes in the oscillator frequency, in accordance with the present invention;

FIG. 4 shows a radio transmitter which can be turned on by the circuit of FIG. 3 to operate a "beeper" worn by a person; and FIG. 5 is a block diagram of the beeper.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
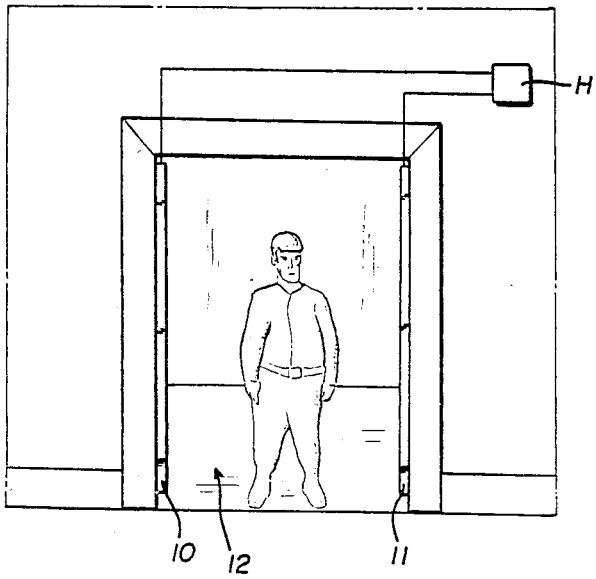
FIG. 1 is an elevational view showing a person in a doorway equipped with capacitor plates in accordance with this invention.

Referring to FIG. 1, in accordance with the present invention a pair of capacitor plates 10 and 11 are mounted on the opposite sides of a doorway 12 leading into a room or multiroom area inside a building which only certain authorized persons are supposed to enter and leave freely. Other persons, such as mental patients, are not supposed to pass through this doorway without initiating an alarm or a notifying signal to staff personnel. Thus, if an unauthorized person, such as a patient, goes through the doorway that fact will be signalled to person whose job it is to keep track of the whereabouts of the patients.

Figure 2:
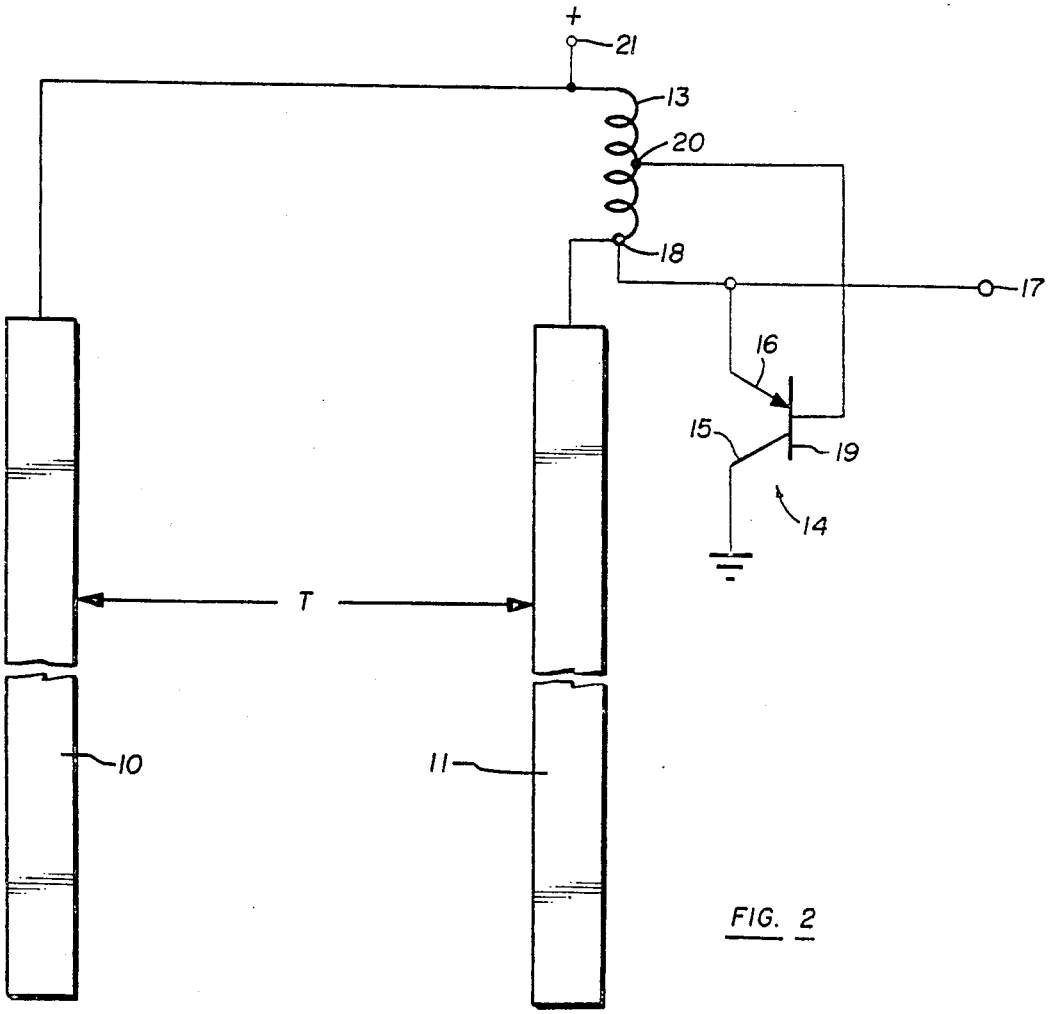
FIG. 2 is a schematic circuit diagram of an oscillator including these capacitor plates, which are shown enlarged.

As shown in FIG. 2, the capacitor plates 10 and 11 and whatever occupies the space between them (normally air) constitute a capacitor which is connected in parallel with an inductance coil 13 to provide a parallel L-C resonant circuit. This L-C circuit is part of an oscillator which includes a PNP transistor 14 having a grounded collector 15, and an emitter 16 connected to the oscillator output terminal 17 and to the juncture 18 between capacitor plate 11 and the lower terminal of coil 13. The base of 19 of transistor 14 is connected to an intermediate tap 20 on coil 13. A positive power supply terminal 21 is connected to the upper end of coil 13.

In FIG. 1 all the components of this oscillator except the capacitor plates 10 and 11 are enclosed in a housing H on the building wall near the doorway 12 being monitored.

The frequency of oscillation depends upon the reactance values of coil 13 and the capaitor which has plate 10 and 11. The reactance of this capacitor depends upon the dielectric constant of what is between its plates.

When the doorway 12 is empty and air fills the space between capacitor plates 10 and 11,the dielectric constant is low and the oscillator frequently is relatively high.

When a person's body is in the doorway between the capacitor plates 10 and 11,the dielectric constant of the capacitor is much higher than it is for air and it remains at that high level as long as any substantial part of the person's body is still between the capacitor plates. Consequenly, the oscillator frequently at this time is much lower than it is when only air is between the capacitor plates.

When the person in the doorway is wearing or carrying a small metallic object, such as a bracelet on the wrist or the ankle or a metallic name tag on a chain around the neck on the person's clothing, the passage of that small metallic object between the capacitor plates will reduce the dielectric constant of the capacitor abruptly, and the oscillator frequently will increase as long as that object is between the capacitor plates 10 and 11.

FIG. 3 shows a circuit for detecting whether or not a person going through the doorway is wearing such a metal object. The oscillator output terminal 17 in FIG. 2 is the input terminal if the FIG. 3 circuit.

This circuit has an operational amplifier 22 with a non-inverting input terminal 23 and an inverting input terminal 24. Between terminals 17 and 23 the circuit has in succession, in series, a buffer ampliflier 25, a rectifier 26, a potentiometer 27 and a resistor 28. A resistor 29 is connected between the output terminal of ampliflier 25 and ground. This terminating resistance for the ampliflier has a low value, such as 100 ohms. A capacitor 30 is connected between the output terminal (cathode) of rectifier 26 and ground. The complete resistor which provides potentiometer 27 is connected in parallel with capacitor 30, i.e., between the output side of rectifier 26 and ground. Capacitor 30 acts as a low pass filter which bypasses to ground any signals of frequencies above a certain cutoff value, which is determined by the capacitance of capacitor 30.

Between terminals 17 and 24 the circuit of FIG. 3 has in succession, in series, a buffer amplifier 31, a capcitor 32, a rectifier 33 and a resistor 34. A resistor 35 is connected between the output terminal of amplifier 31 and ground. This terminating resistance for the amplifier has a low ohmic value, such as 100 ohms. Two resistors 36 and 37 are connected in sreies between the input terminal (anode) of rectifier 33 and ground. A capacitor 38 is connected between the output terminal (cathode) of rectifier 33 and ground. Capacitor 38 acts as a low pass filter.

The circuit of FIG. 3 also has a frequency-to-voltage converter 39 of known design connected between terminal 17 and the base of a field effect transistor 40 whose output terminals are connected across resistor 37 i.e., one output terminal of FET 40 is connected to the jucture 41 between resistors 36 and 37 and the other output terminal of FET 40 is grounded. The frequency-to-voltage converter 39 produces an output signal whose instantaneous voltage amplified is proportional to the instantaneous frequentcy of the input signal it recieves at terminal 17 from the oscillator of FIG. 2.

Capacitor 32, resistors 36 and 37, and FET 40 constitute a high pass filter. Converter 39 and FET 40 control the cut-off frequency of this high pass filter.

The operational amplifier 22 has a feedback loop with an adjustable resistor 42 to control the amplifier gain.

A resistor 43 is the terminating impedance for the circuit of FIG. 3. The output of the operational amplifier 22 is connected through a flip flop 44 of known design to an output terminal 45, which may be connected to an audible or visual alarm signalling device (not shown).

In the operation of this system, as long as the doorway 12 is empty the oscillator frequency will be so high that the low pass filters 30 and 38 prevent the oscillator output signal from being applied to either input terminal of the operational amplifier 22.

When a person enters the doorway, his or her body capacitance reduces the oscillator freuency. This reduction in the oscillator frequency reduces the output voltage of the frequency-to-voltage converter 39 and through FET 40 this causes the cutoff frequency of the high pass filter 32, 36, 37, 40 to be lowered, i.e., to follow the now-reduced oscillator frequency. The adjustable tap on potentiometer 27 will have been set so that when a person's body (without any metal object) is in the doorway the output of the operational amplifier 22 is at its midpoint (substantially zero volts).

However, a small metal object worn or carried by the person will cause the oscillator frequency to increase because that object reduces the effective dielectric constant between the capacitor plates 10 and 11 on opposite sides of the doorway. The path from the oscillator output 17 to the non-inverting input 23 of the operational amplifier 22 has a different time constant than the path from the oscillator output 17 to the inverting input 24 of the op-amp. As a result of this time constant difference the signal applies to the inverting input 24 of the operatinal amplifier 22 goes positive with respect to the signal applies to its the non-inverting input 23. This causes a transient negative output signal from the operational amplifer which trips flip-flop 44, which now provides a signal for actuating an alarm device of any suitable type, audible, visual or otherwise.

Thus, the present system discriminates between a person who is carrying or wearing a small metal object and a person who is not.

Preferably, the alarm signalling equipment which is turned on by the flip-flop 44, as already described, includes a radio transmitter 46 (FIG. 4) which broadcasts a signal from an antenna 47 which turns on a "beeper" or other sound-producing device 48 worn by a person or persons. If that person is a patient who has just passed through the doorway, other persons close enough to the patient to hear the beeper will be alerted to the fact that the patient is outside the premises where he or she is supposed to be. Alternatively, if the beeper is worn by nurses and other hospital attendants, the beeper will notify all of them that a pateient has just gone through the doorway and those who are nearby can immediately go toward it for the purpose of intercepting the patient.

As shown schematically in FIG. 5, the beeper 48 includes a radio receiver 49 powered by a battery 50 and tuned to the frequency of transmitter 46. The radio receiver 49, in response to the reception of a signal from transmitter 46, turns on an audible alarm device 51 which may be reset to an "off" condition by any suitable reset arrangment 52, which may be operated manually by a nurse, security guard or other authorized person.

I claim:

1. A detection system comprising:

a pair of metallic plates adapted to be mounted on the opposite sides of a passageway to form a capacitor whose reactance depends upon the effective dielectric constant of what is in the space between said plates;

an oscillator which includes said capacitor, said oscillator having a frequency which varies with the reactance of said capacitor;

and a discriminating circuit connected to the output of said oscillator and having means responsive to the oscillator frequency for discriminating between the presence of a person's body without an electrically conductive article in said passageway between said plates and the presence of a person's body with an electrically conductive article in said passageway between said plates.

2. A detection system according to claim 1 wherein said discriminating circuit comprises:

an operational amplifier having a non-inverting input, an inverting input and an output;

means providing a path from the oscillator output to one of said inputs of the operational amplifier including a first low pass filter;

means providing a separate path from the oscillator output to the other of said inputs of the operational amplifier including a high pass filter and a second low pass filter;

frequency sensitive means for varying the cutoff frequency of said high pass filter in accordance with the oscillator frequency;

and adjustable means for causing the output of said operational amplifier to be at substantially its midpoint when the oscillator frequency reflects the presence in said passgeway between said plates of a person without an electrically conductive article;

said path from the oscillator output to said one input of the operational amplifier having a different time constant than said path from the oscillator output to the other of said inputs of the operational amplifier, whereby to produce a transient signal on the output of said operational amplifier when a person with an electrically conductive article passes through said passageway between said plates.

3. A detection system according to claim 2 and further comprising:

respective buffer amplifiers in said paths between the oscillator output and the respective filters for isolating the oscillator.

4. A detection system according to claim 3 wherein:

said first low pass filter is in the path to the non-inverting input of the operational amplifier;

and said adjustable means is a potentiometer connected between said first low pass filter and the non-inverting input of the operational amplifier.

5. A detection system according to claim 4 wherein:

said high pass filter comprises a capacitor connected in series between the oscillator output and the inverting input of the operational amplifier, and resistance means connected between said capacitor and ground, said resistance means including a field effect transistor;

and said frequency sensitive means is a frequency-to-voltage converter operatively connected between the oscillator output and the field effect transistor to change the latter's impedance with changes in the oscillator frequency.

6. A detection system according to claim 2 wherein:

said first low pass filter is in the path to the non-inverting input of the operational amplifier;

and said adjustable means is a potentiometer connected between said first low pass filter and the non-inverting input of the operational amplifier.

7. A detection system according to claim 6 wherein:

said high pass filter comprises a capacitor connected in series between the oscillator output and the inverting input of the operational amplifier, and resistance means connected between said capaitor and ground, said resistance means including a field effect transistor;

and said frequency sensitive means is a frequency-to-voltage converter operatively connected between the oscillator output and the field effect transistor to change the latter's inpedance with changes in the oscillator frequency.

8. A detection system according to claim 2 wherein:

said high pass filter comprises a capacitor connected in series between the oscillator output and the inverting input of the operational amplifier, and resistace means connected between said capacitor and ground, said resistance means including a field effect transistor;

and said frequency sensitive means is a frequency-to-voltage converter operatively connected between the oscillator output and the field effect transistor to change the latter's impedance with changes in the oscillator frequency.

* * * * *